US007926309B2

(12) United States Patent
Kim et al.

(10) Patent No.: US 7,926,309 B2
(45) Date of Patent: Apr. 19, 2011

(54) WASHING MACHINE HAVING WIRELESS COMMUNICATING CONTROLLER THEREIN

(75) Inventors: Young Soo Kim, Changwon-si (KR); Soung Bong Choi, Changwon-si (KR); Byung Hwan Ahn, Gimhae-si (KR); Hyeok Deok Kim, Changwon-si (KR); Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 563 days.

(21) Appl. No.: 11/652,655

(22) Filed: Jan. 12, 2007

(65) Prior Publication Data

US 2007/0186594 A1 Aug. 16, 2007

(30) Foreign Application Priority Data

Jan. 13, 2006 (KR) ..... 10-2006-0003932

(51) Int. Cl.
*D06F 33/02* (2006.01)

(52) U.S. Cl. ..... 68/3 R; 68/12.23; 68/23 R

(58) Field of Classification Search ..... 68/3 R, 68/12.01, 12.23, 23 R
See application file for complete search history.

(56) References Cited

U.S. PATENT DOCUMENTS

| | | | | |
|---|---|---|---|---|
| 5,089,809 | A * | 2/1992 | Carmichael, Jr. | 340/679 |
| 6,539,570 | B2 * | 4/2003 | Youn et al. | 8/159 |
| 6,778,868 | B2 * | 8/2004 | Imamura et al. | 700/79 |
| 6,784,801 | B2 * | 8/2004 | Watanabe et al. | 340/679 |
| 6,850,149 | B2 * | 2/2005 | Park | 340/7.1 |
| 6,956,461 | B2 * | 10/2005 | Yoon et al. | 340/310.11 |
| 7,464,426 | B2 * | 12/2008 | Lee et al. | 8/147 |
| 2001/0025392 | A1 * | 10/2001 | Youn et al. | 8/159 |
| 2005/0138835 | A1 * | 6/2005 | Lyu et al. | 34/596 |
| 2005/0140506 | A1 * | 6/2005 | Oh et al. | 340/538 |
| 2005/0155393 | A1 * | 7/2005 | Wright et al. | 68/3 R |
| 2006/0225301 | A1 * | 10/2006 | Lyu et al. | 34/595 |
| 2006/0225302 | A1 * | 10/2006 | Lyu et al. | 34/595 |

FOREIGN PATENT DOCUMENTS

| | | | |
|---|---|---|---|
| DE | 296 22 066 | U1 | 5/1998 |
| EP | 513688 | A1 * | 11/1992 |
| EP | 1 548 679 | A2 | 6/2005 |
| GB | 2015870 | A * | 9/1979 |
| GB | 2265158 | A * | 9/1993 |
| JP | 2002-085891 | | 3/2002 |
| KR | 10-2005-0066532 | | 6/2005 |

* cited by examiner

*Primary Examiner* — Joseph L Perrin
(74) *Attorney, Agent, or Firm* — KED & Associates, LLP

(57) ABSTRACT

A washing machine having a wireless communicating controller therein is disclosed, by which electric wires used for a controller in the washing machine are reduced and by which a main control unit is separated from an input unit or a display unit to secure a free movement and by which an installation position of an input unit or a display unit can be easily changed.

20 Claims, 8 Drawing Sheets

WASHING MACHINE HAVING WIRELESS COMMUNICATING CONTROLLER THEREIN

This application claims the benefit of the Korean Patent Application No. 10-2006-0003932, filed on Jan. 13, 2006, which is hereby incorporated in its entirety by reference as if fully set forth herein.

BACKGROUND OF THE INVENTION

1. Field of the Invention

The present invention relates to a laundry machine such as a washing machine or a clothes dryer, and more particularly, to a laundry machine having a wireless communicating controller therein. Although the present invention is suitable for a wide scope of applications, it is particularly suitable for configuring a controller with a main control unit and an input or display unit separated from the main control unit and performing wireless data communications between the main control unit and the input unit or the display unit.

2. Discussion of the Related Art

Generally, a washing machine is a mechanical device that performs a washing cycle, a rinsing cycle, a dewatering cycle, and the like by rotating a drum or pulsator via a driving force of a motor. After laundry and water have been put into a drum, they are agitated to perform washing using the frictions between the laundry, water and drum.

Washing machines can be classified into a pulsator type washing machine, an agitator type washing machine, a drum type washing machine, and the like.

The drum type washing machine is a device that performs washing using a friction between a washing drum and laundry while a detergent, water and laundry are put into the washing drum. In this case, the washing drum is rotated by receiving a driving force of a driving part. Hence, the drum type washing machine is advantageous in causing less damage on the laundry, preventing the ravel of the laundry, and bringing washing effects of beating and rubbing.

FIG. 1 is a perspective diagram of a drum type washing machine according to a related art.

Referring to FIG. 1, a controller 3 is provided to an upper part of a front side of a body of a drum type washing machine. In this case, the controller 3 includes function input keys for user's washing controls and a display unit displaying a remaining time and the like.

A plurality of buttons 31, a display window 32, an LED window 33 and a rotary knob 50 are provided to the controller 3. Each of the buttons 31 and the rotary knob 50 are input tools to operate the washing machine. A user manipulates the buttons 31 and the knob 50 to input a specific washing course and time and the like in selecting a washing time, a washing type, a dewatering type, a drying type, etc.

The LED window 33 informs a user of various kinds of washing information such as a washing progress status, a remaining time and the like via flickering. And, the display window 32 informs a user of various kinds of washing information such as a washing progress status, a remaining time and the like via characters and symbols.

If a user selects the washing type or the like via the rotary knob 50 and/or the buttons 31, a main control unit of the controller 3 controls washing associated information to be displayed on the LED window 33 or the display window 32 and controls the washing machine to be operated according to the inputted information.

Meanwhile, a clothes dryer is a mechanical device that automatically dries wet clothes after completion of washing. And, like the drum type washing machine shown in FIG. 1, a clothes dryer according to a related art is provided with a controller including an input means, a display means, a main control unit and the like.

Since the controller is provided to an upper part of a body of the related art washing machine or clothes dryer, if the washing machine or clothes dryer is installed at a high level far from a position where a user stands, the user has difficulty in accessing the controller. Hence, the user is inconvenient in using the controller. And, there is another inconvenience for a user to view a display unit by raising his head to observe a corresponding state displayed on the display unit.

In case that the washing machine and the clothes dryer are arranged parallel to each other at a relatively lower place, the user will not have trouble using the controllers which are located to the upper part of the machines. However, if one of the washing machine and the clothes dryer is placed at a high place, for example on top of the other, the user is expected to have trouble using the controller of the one which is placed at a high place.

Besides, in the controller of the related art washing machine or clothes dryer, data communications between the main control unit and input unit or the display unit are carried out by wire communication. In the related art, communication lines are mandatory for the wire communication. And, the wire communication also makes the arrangement of the communication lines so complicated that the main control unit, the input unit, and the display unit are preferred to be put near one another.

With the wire communication, 29 electric wires are generally necessarily used for making electrical connections among them. It is very time-consuming to put the number of wires in electrical connection to the units.

After completion of connecting the electric wires to assemble the controller, it is very inconvenient to treat the controller, since the units of the controller need to be moved together. Sometimes, it is necessary to remove from the machine one unit of the controller. In this case, the wires cause inconvenience, too. In particular, in case that one unit of the controller needs to be moved, the inconvenience becomes worse. Moreover, if the input unit or the display unit moves to be placed in another position, the wire communication system is inappropriate.

Besides, since the washing machine or the clothes dryer is in a close relation to water, the electric wires within the machines should be treated to prevent short circuit by water.

SUMMARY OF THE INVENTION

Accordingly, the present invention is directed to a laundry machine having a wireless communicating controller therein that substantially obviates one or more problems due to limitations and disadvantages of the related art.

An object of the present invention is to provide a laundry machine having a wireless communicating controller therein, by which electric wires used for a controller in the washing machine are reduced and by which it is easy to separate and move an input unit or a display unit from a main control unit.

Another object of the present invention is to provide a washing machine having a wireless communicating controller therein, by which a mounting position of an input unit or a display unit can be easily changed.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine according to the present invention includes a main control unit controlling an operation of the laundry machine and a user-interface unit having an input unit or a display unit. The input unit receives from a user an input of a command for an operation and the display unit displays information associated with the operation. The user-interface unit can be detached from the machine easily disconnected electrically from the main control unit. The user-interface unit wirelessly communicates data with the main control.

In a washing machine as an example for the laundry machine, a drum accommodating a laundry therein, a motor rotating the drum, a water supply valve adjusting a water supply of water, a drain pump for a water drain and the like are provided within a washing machine body. And, a controller includes a main control unit controlling the motor, the water supply valve, the drain pump and the like according to an installed washing course, an input unit receiving a user's selection of a washing course, and a display unit displaying information associated with the operation of the laundry machine to the user.

Preferably, the user-interface unit includes both of the input unit and the display unit.

More preferably, the display unit and the input unit are built in one body.

In this case, 'the display unit and the input unit are built in one body' means that the display unit and the input unit can be moved in one body but does not always mean that the display unit and the input unit are unified into one on a PCB or the like in detail configurations.

For instance, the display unit and the input unit are provided to a panel such as a housing that accommodates the respective detailed elements, thereby moving together.

Preferably, if possible, detailed elements of the display unit and the input unit are built in one body. For instance, PCBs of the display unit and the input unit are unified into one PCB.

If one element of the input unit is a touchscreen type via an LCD window, the LCD window can be used for displaying as well. So, the display unit and the input unit can be unified into one body.

The machine body can be provided with an upper attachment structure provided to an upper part of the body and a lower attachment structure under the upper part of the body to enable the user-interface unit to be selectively and detachably attached to a first or second position.

If an external input unit is provided and available at a place easily accessible, a user is able to conveniently manipulate the laundry machine by using the external input unit even without using the input unit mounted to the body. In this case, the user-interface unit can have the display unit only.

Preferably, when the user-interface unit is attached to one of the attachment structures, a cover panel is attached to the other. To attach the cover panel, the upper or lower attachment structure can be used or other attachment structure, such as a screw locking hole and the like, provided for only the cover panel can be used. What should be noted here is that the cover panel is attached to the other side where the user-interface unit is not attached. And, this does not mean that the upper or lower attachment structure is naturally used for the attachment of the cover panel.

In the present invention, the attachment structures can have any type and any shape, if they can function as needed. The attachment structures are not restricted to a specific shape. And, a related art attachment structure can be used intact. Unless deviating from the objects of the present invention, any kind of attachment structure can be employed as the attachment structure of the present invention. It is preferred to use specific attachment structures which can make the attachment of the user-interface unit easily attached and detached.

Alternatively, without providing the attachment structures to the body, magnets can be provided to the user-interface unit so that the unit can be attached to the body by the magnetic forces. Even in this case, it is more preferable that the body has attachment structures so as to provide at least places for housing the user-interface unit.

In the present invention, the body has a relative meaning to the controller. It indicates a part that performs original functions of the machine by being controlled by the controller. For instance, the washing machine body can include a drum accommodating laundry therein and a driving unit (e.g., motor, etc.) driving the drum, wherein the driving unit is controlled by the controller. Besides, a dryer body can include a drum accommodating laundry to be dried therein and a driving unit driving the drum.

In the laundry machine according to the present invention, the main control unit and the user-interface unit exchange data with each other by wireless communication. For this, communication means are provided to the main control unit and the user-interface unit.

The user-interface unit is provided with a microcomputer controlling input means such as buttons and the like or display means such as an LCD window and the like.

The microcomputer provided to the user-interface unit exchanges data with another microcomputer provided to the main control unit by wireless communications.

In case of the input unit, if a user inputs a command, the command is inputted to the microcomputer of the user-interface unit. The microcomputer then transmits the command to the microcomputer of the main control unit by wireless communications. If so, the main control unit controls the elements of the laundry machine according to the received command to perform a job.

In case of the display unit, the microcomputer of the main control unit transmits data to the microcomputer of the user-interface unit by wireless communications. If so, the microcomputer of the user-interface unit controls the display means according to the transmitted information to display prescribed information externally.

The wireless communications can be implemented in various ways. For instance, there are infrared communications used for a television remote controller or the like, radio frequency communications, blue-tooth, etc.

First of all, IrDA (Infrared Data Association) for the infrared communications was established in 1993 as an organization supported by industries to prepare international standards for hardware and software used for infrared communication link. In the infrared communications as a special type of wireless transmissions, a light beam focused within infrared frequency spectrum measured in tera- or trillion-hertz is modulated into information to be sent to a receiver within a relatively short distance. And, the infrared irradiation is carried out the same technique as used in controlling TV with a remote controller.

Infrared data communications play an important role in wireless data communications nowadays according to the popularization of laptops, PDAs, digital cameras, mobile phones, radio pagers, etc.

In the infrared communications, there should be transceivers provided to both sides, respectively. And, special microchips are provided for the function. In addition, special software is necessary for one or more devices to synchronize the communications. For example, there is a special support for IR in MS Window 95 operating system. In IrDA-1.1 standard, a length of the transmittable longest data is 2.048 bytes and a maximum data rate is 4 Mbps.

IR is usable for mutual connections in an approximately long distance and has mutual connection possibility within LAN. A maximum valid distance is about 1.5 mile and a maximum designed bandwidth is 16 Mbps. IR is carried by transmitting visible rays. So, IR is very sensitive to such an atmospheric condition as mist and the like.

Meanwhile, a terminology, radio frequency (RF), indicates an alternate current having a characteristic that an electromagnetic field suitable for radio broadcasting or communications is generated if an input entering an antenna is a current. Theses frequencies ranges between 9 kHz (lowest frequency assigned to radio communications: belonging to audible range) and several-thousand GHz to cover important parts of electromagnetic irradiation spectrum.

If a radio frequency current is supplied to an antenna, an electromagnetic field propagating through a space is generated. The magnetic field is called a radio frequency magnetic field or a radio wave. Every radio frequency magnetic field has a wavelength inverse-proportional to a frequency. If a frequency and a wavelength are set to 'f' and 's', respectively, it results in s=300/f. A radio frequency signal is inverse-proportion to a quantity corresponding to an electromagnetic wavelength. A free space wavelength at 9 kHz is about 33 km. An electromagnetic wavelength at the highest radio frequency is about 1 mm. As a frequency increases over a radio frequency spectrum, electromagnetic energy becomes infrared rays, visible rays, ultraviolet rays, gamma rays, etc.

Most of the radio equipments use radio frequency magnetic fields. Cordless phones, mobile phones, radio or TV broadcasting stations, satellite communication systems, interactive radiotelegraphs and the like work within the radio frequency spectrum. Some of the radio equipments work in IR or visible ray frequency having an electromagnetic wavelength shorter than that of a radio frequency magnetic field. For example, there are TV remote controllers, wireless keyboards, wireless mouse, wireless headphone sets, etc.

The radio frequency spectrum is divided into several kinds of bands. Except a lowest frequency band, each zone means a frequency ascent according to an order of size (power of 10). Eight bands within a radio frequency band are described in the following table, which shows a frequency and a range of bandwidth. SHF and EHT bands are often called a ultra high frequency spectrum.

Bluetooth is the specification of computer and communication industries, which facilitates mobile phones, computers, PDAs and the like to be connected to phones and computers of home or office that uses wireless LAN. Bluetooth is the name of the legendary Danish King. Bluetooth was developed by the consortium of five companies, Intel, IBM, Nokia, Ericsson and the like. To use this technique, each device needs a cheap transceiver chip.

Each device is equipped with a microchip transceiver capable of transmission/reception at 2.45 GHz that is a globally available frequency band (yet, some countries may use different frequency bands). Audio channels can be used as many as three except data channel. Each device has a unique 48-bit address from IEEE 802 standard. Point-to-point access or point-to-multipoint access is possible. And, a maximum communication available range is 10 m. And, a data rate is 1 Mbps (maximum 2 Mbps by the second generation technique). A frequency hop design enables communication in an area experiencing massive electromagnetic hindrance. And, loaded encryption and verification functions are provided.

Meanwhile, a dual laundry machine according to the present invention includes a pair of laundry machines arranged parallel with or vertical to each other. At least one of a pair of the laundry machines includes a main control unit controlling an operation of the laundry machine and a user-interface unit having an input unit receiving an input of a command for an operation from a user or a display unit displaying information associated with the operation. The user-interface unit can be detached from the machine easily disconnected electrically from the main control unit. The user-interface unit wirelessly communicates data with the main control.

In the laundry machine, the number of electric wires used for the controller is minimized. The main control unit and the user-interface unit are separated from each other to enable free movements. Since the user-interface unit can be easily disconnected from the main control unit and detached from the machine body, maintenance for the user-interface unit can be carried out easily.

In addition, due to the wireless communication, the place exchange of the user-interface unit between the first position and the second position can be achieved easily.

The selectively place exchangeable user-interface unit provides many effects as follows.

Wherever, even at a high place, the laundry machine is placed, it can be conveniently used. So, less limitation is put on the place where the machine is located than the conventional laundry machine.

In the dual laundry machine including a dryer and a washing machine, a user can arrange the dryer and the washing machine not only parallel but also vertically. The arrangement diversity brings affirmative effects and enables less limitation to be put on an installation place and space.

Meanwhile, the laundry machine according to the present invention can be more usefully used by a launderette that commercially uses many dryers and washing machines. For instance, if a user-interface unit of one of a plurality of dryers is out of order, a user-interface unit of another dryer is disassembled to be assembled to the out-of-order dryer for a temporary solution. If a body of one dryer is out of order and if a user-interface unit of another dryer is out of order, the user-interface unit of the latter dryer can be replaced by a user-interface unit of the former dryer to complete one dryer that works normally.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
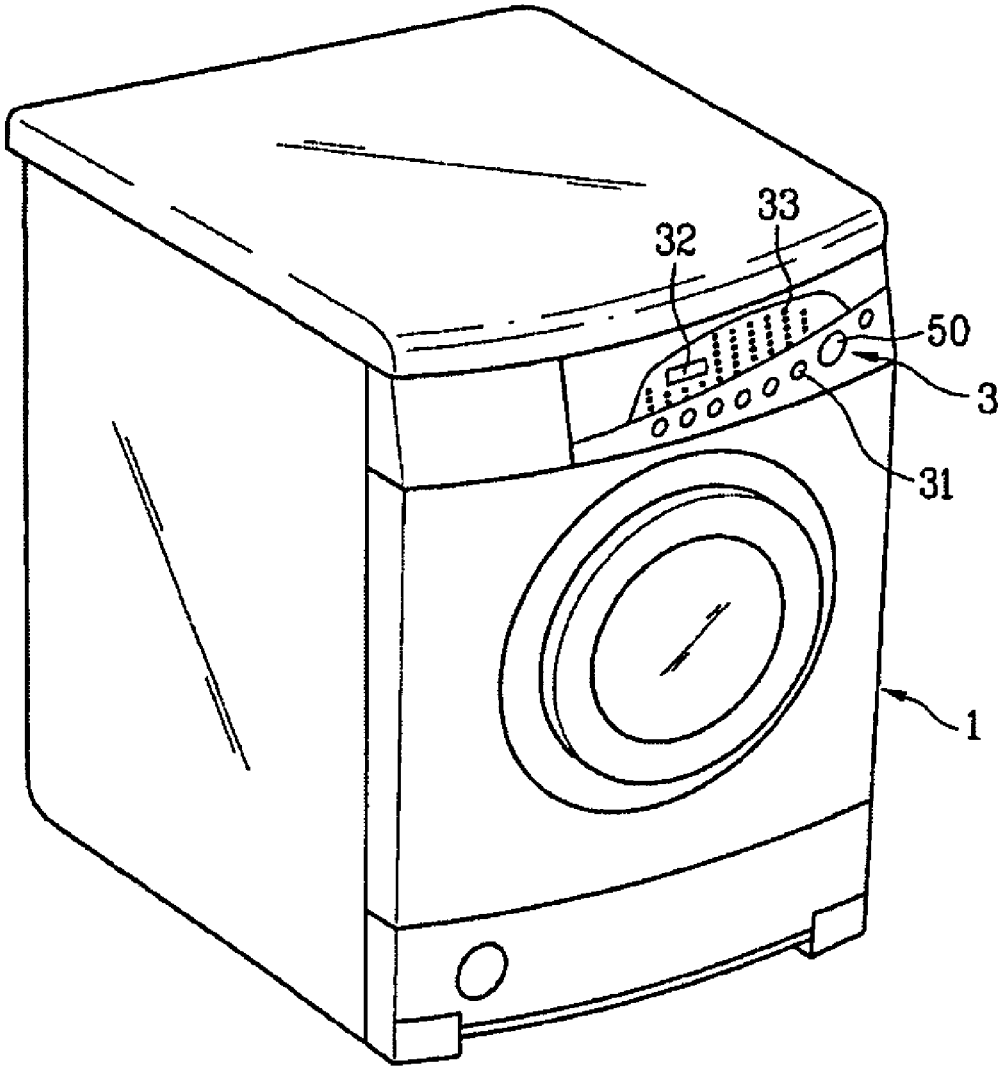
Fig. 1 Prior Art
FIG. 1 is a perspective diagram of a drum type washing machine according to a related art.
Figure 2:
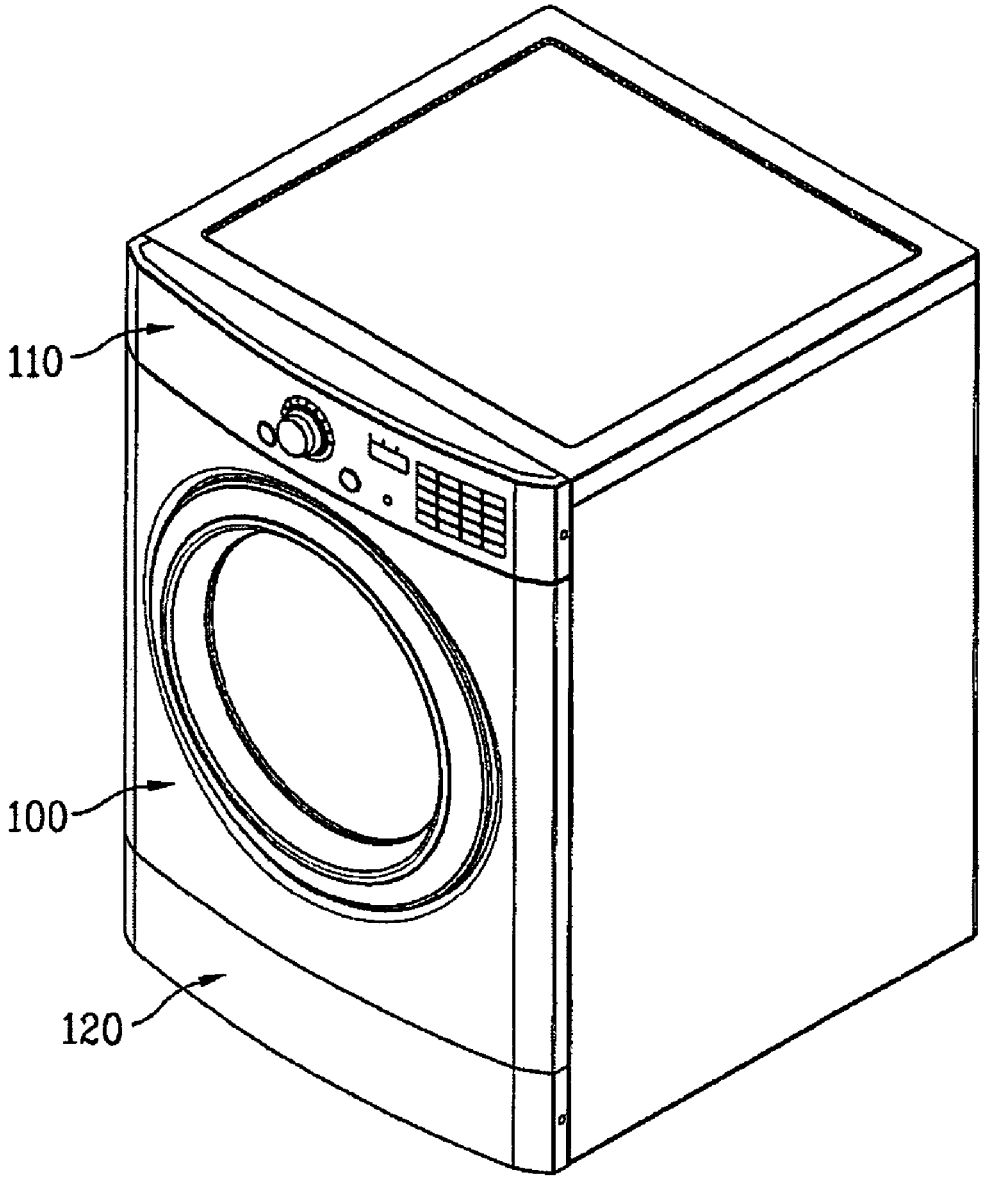
FIG. 2 is a perspective diagram of a dryer according to a preferred embodiment of the present invention.

FIG. 2 is a perspective diagram of a dryer according to a preferred embodiment of the present invention.

Referring to FIG. 2, a user-interface unit 110 of a controller is provided to an upper part of a dryer body 100 and a cover panel 120 is provided to a lower part of the dryer body 100.

The user-interface unit 110 and the cover panel 120 are detachably provided to the body 100 and can be easily detached from the body 100. And, installed positions of the user-interface unit 110 and the cover panel 120 can be mutually switched. In more detail, the user-interface unit 110 is detached from the body 100 and then provided to the lower part of the body 100 where the cover panel 120 was provided. And, the cover panel 120 is attached to the upper part of the body 100 where the user-interface unit 110 was attached.

Figure 3:
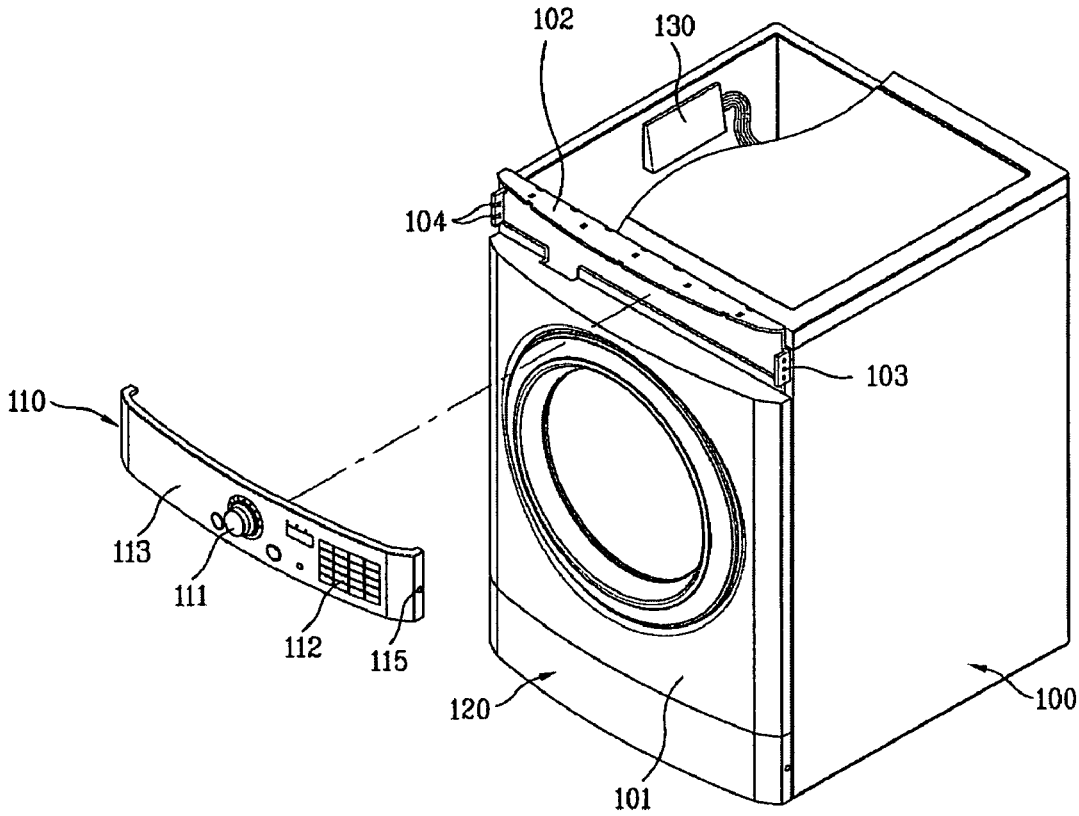
FIG. 3 is an exploded perspective diagram of a user-interface unit assembled to a body in the dryer shown in FIG. 2.

FIG. 3 is an exploded perspective diagram of a user-interface unit assembled to a body in the dryer shown in FIG. 2.

Referring to FIG. 3, the user-interface unit 110 will be attached to the upper part of the body 100.

First of all, in the present embodiment, a main control unit 130 of a controller is provided within the body 100. And, the user-interface unit 110 includes an input unit and display unit built in one body.

The user-interface unit 110, as shown in FIG. 3, is provided with various buttons and a knob as an input unit to input drying conditions for the laundry drying and the like. And, the user-interface unit 110 is also provided with an LCD window or an LED as a display unit to display a signal received from the main control unit 130.

The various buttons, knob, LCD, LED and the like are provided to a the user-interface unit PCB (not shown in the drawing). And, the user-interface unit PCB is fixed to a user-interface unit panel 113. In this case, the user-interface unit PCB is configured with an input unit PCB for the input unit only and a display unit PCB separated from the input unit PCB for the display unit only. Preferably, the input unit PCB and the display unit PCB are unified into one PCB to be built in one body.

A screw locking hole 115 and a projection 177 for a locking are provided to both sides of the user-interface unit panel 113 to be attached to upper attachment structures 103 and 104 and lower attachment structures 143 and 144, respectively.

The upper attachment structures 103 and 104 provided to the body 100 include the screw locking hole 103 provided to one side of an upper frame 102 of the body 100 and the slot 104 locked to the projection 117 provided to the user-interface unit panel 113.

Figure 4:
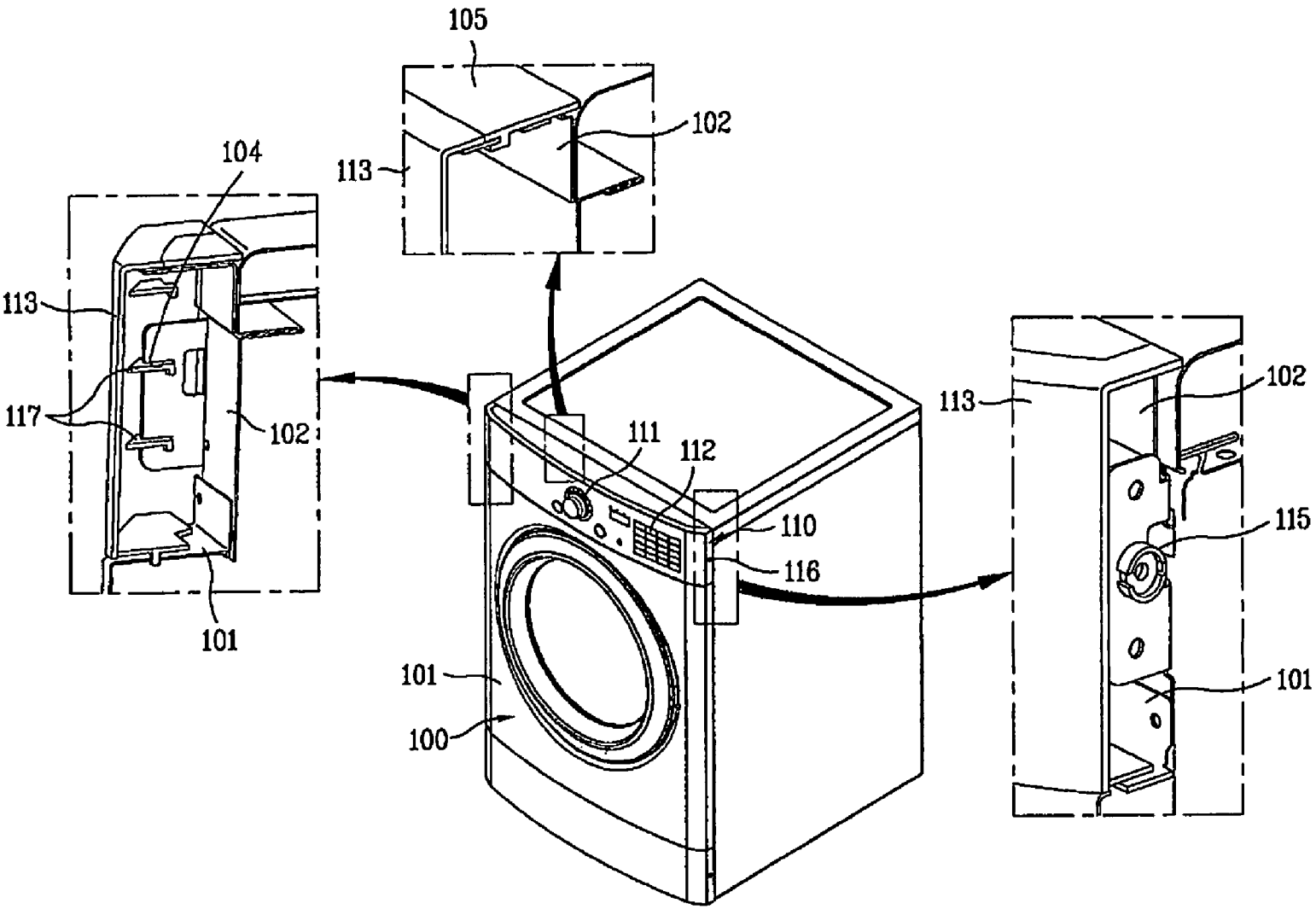
FIG. 4 is a perspective diagram of the dryer shown in FIG. 2 to show enlarged cross-sections of a user-interface unit attached to a body.

FIG. 4 is a perspective diagram of the dryer shown in FIG. 2 to show enlarged cross-sections of a user-interface unit attached to a body.

How to attach the user-interface unit 110 to the body 100 is explained with reference to FIG. 4 and FIG. 3 as follows.

First of all, the upper frame 102 is assembled to a front cabinet 101 of the body 100. While the state of the body 100 is maintained, the user-interface unit 110 is misaligned in a slightly right direction with the upper frame 102 and then slides to move in a right direction. If so, the projection 117 provided to the user-interface unit panel 113 is fitted into the slot 104 provided to the upper frame 102 to be locked thereto. In this case, one side of the projection 117, as shown in FIG. 4, is configured to be bent and the slot 104 is bent to correspond to the configuration of the projection 117. So, once the projection 117 and the slot 104 are locked together, the user-interface unit 110 is prevented from being separated from the body 100 in a front direction.

After completion of this assembly, screws are fitted into the screw locking hole 103 provided to the upper frame 102 and the screw locking hole 115 provided to the user-interface unit panel 113, respectively. Hence, the attachment of the user-interface unit 110 is secured.

While the user-interface unit 110 is attached to the upper part of the body 100, a deco-plate can be further provided for an exterior.

Figure 5:
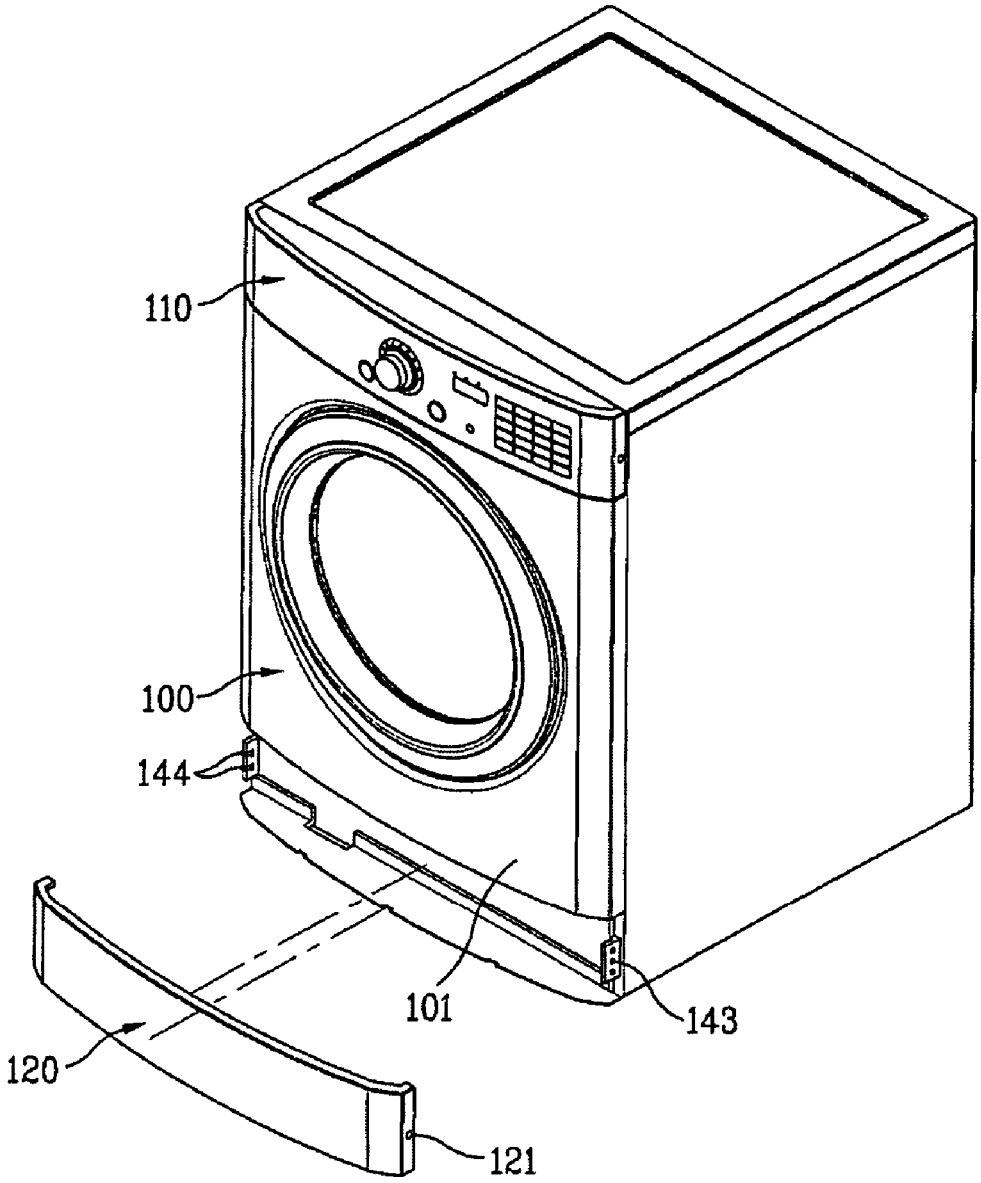
FIG. 5 is an exploded perspective diagram of the dryer shown in FIG. 2 to show a cover panel assembled to a body.

FIG. 5 is an exploded perspective diagram of the dryer shown in FIG. 2 to show the cover panel 120 assembled to a lower part of the body 100.

Referring to FIG. 5, like the user-interface unit panel 113, a screw locking hole 121 and a projection (not shown in the drawing) are preferably provided to the cover panel 120. Alternatively, it is a matter of course that the attachment structure of the cover panel 120 can be configured different from that of the user-interface unit panel 113.

A lower frame is provided to the lower part of the body 100 to correspond to the upper frame 102. Like the upper frame 102, the lower fame is provided with a slot 144 and a screw locking hole 143.

How to assemble the cover panel 120 to the lower frame is the same as assembling the user-interface unit 110, and more particularly, the user-interface unit panel 113 to the upper frame 102, which is omitted in the following description.

Figure 6:
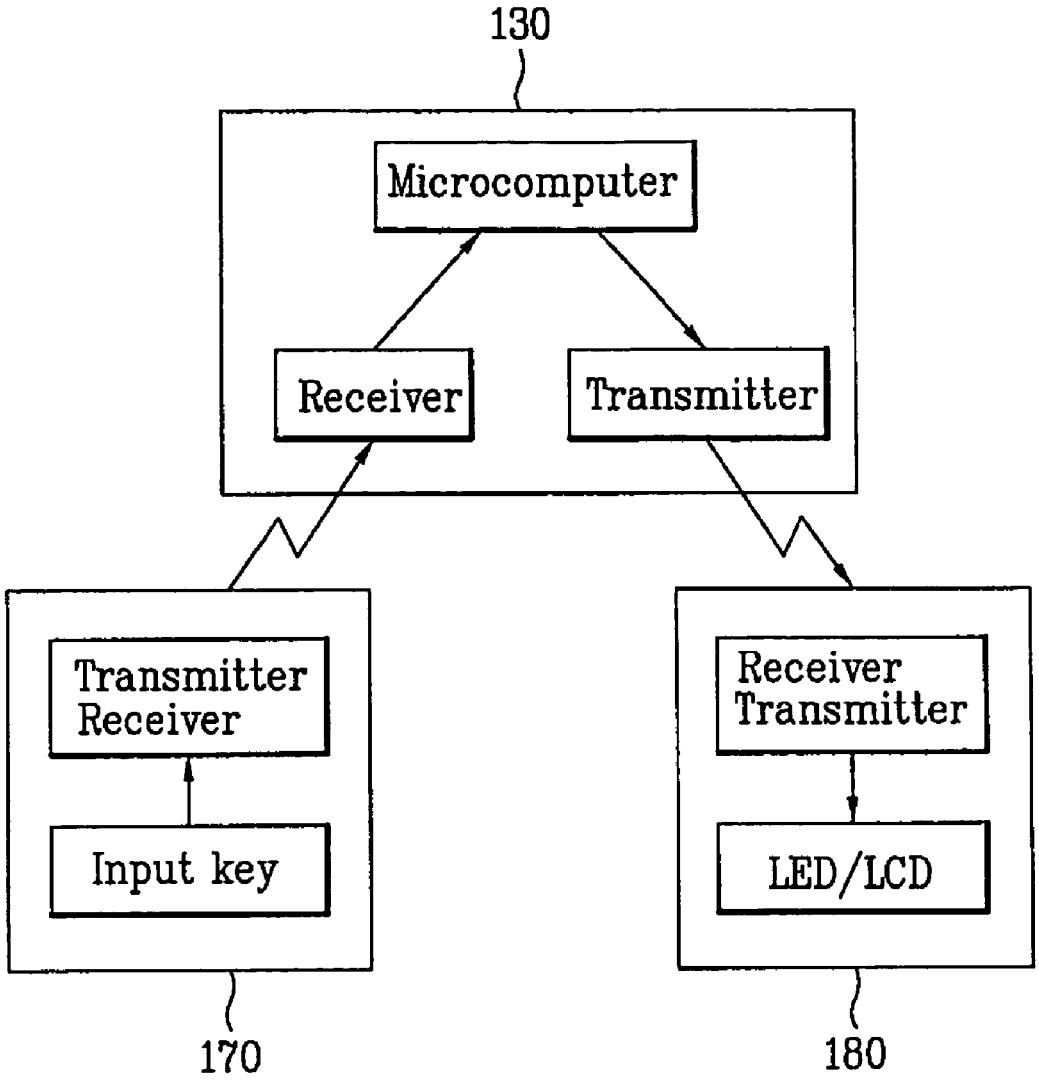
FIG. 6 is a block diagram of a main control unit, an input unit and a display unit to explain wireless communications therebetween.

Communications between the user-interface unit 110 and the main control unit 130 mounted in the body 100 are explained with reference to FIG. 6 as follows.

First of all, if a user inputs commands using input keys of the input unit 170, the input unit 170 transmits the inputted commands to the main control unit 130 via a transmitter.

The main control unit 170 controls a dryer operation according to the commands sent from the input unit 170 and then transfers associated information to the display unit 180 via a transmitter.

The display unit 180 receives the information transmitted by the main control unit 130 and then displays the associated information according to the received information.

The main control unit 130 generally includes a microcomputer and a memory. The main control unit 130 controls a motor to drive a drum, a heater to heat air to be supplied within the drum, a blower to blow the air heated by the heater into the drum, thereby enabling the dryer to perform a drying course.

Meanwhile, the embodiment shown in the drawing is just exemplary and can be modified in various ways that can be easily implemented by those skilled in the art.

For instance, unlike the embodiment described above, the input unit and the display unit can be separately configured from each other so that the attaching positions of the respective units can be switched independently.

Figure 7:
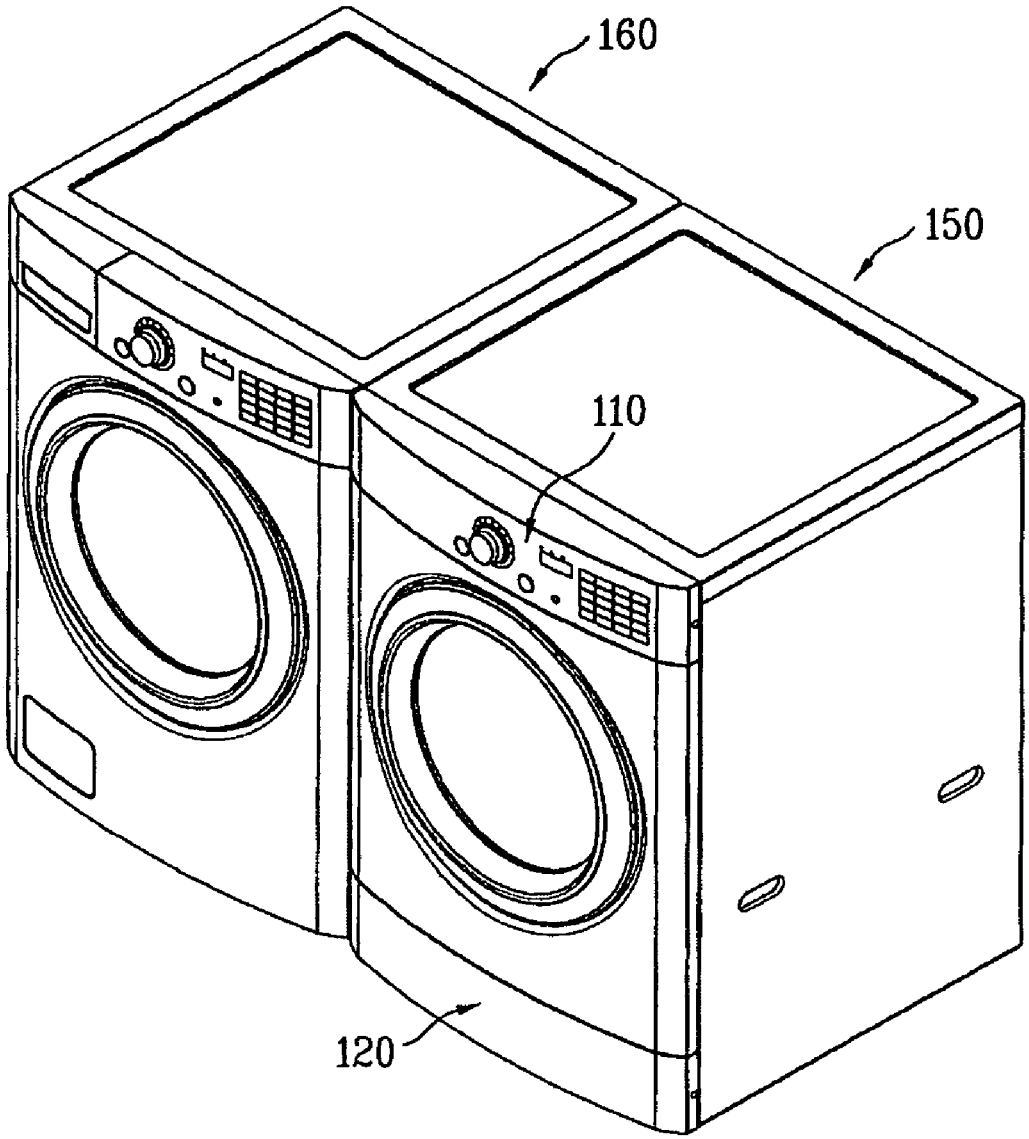
FIG. 7 is a perspective diagram of a dual laundry machine according to one embodiment of the present invention.
Figure 8:
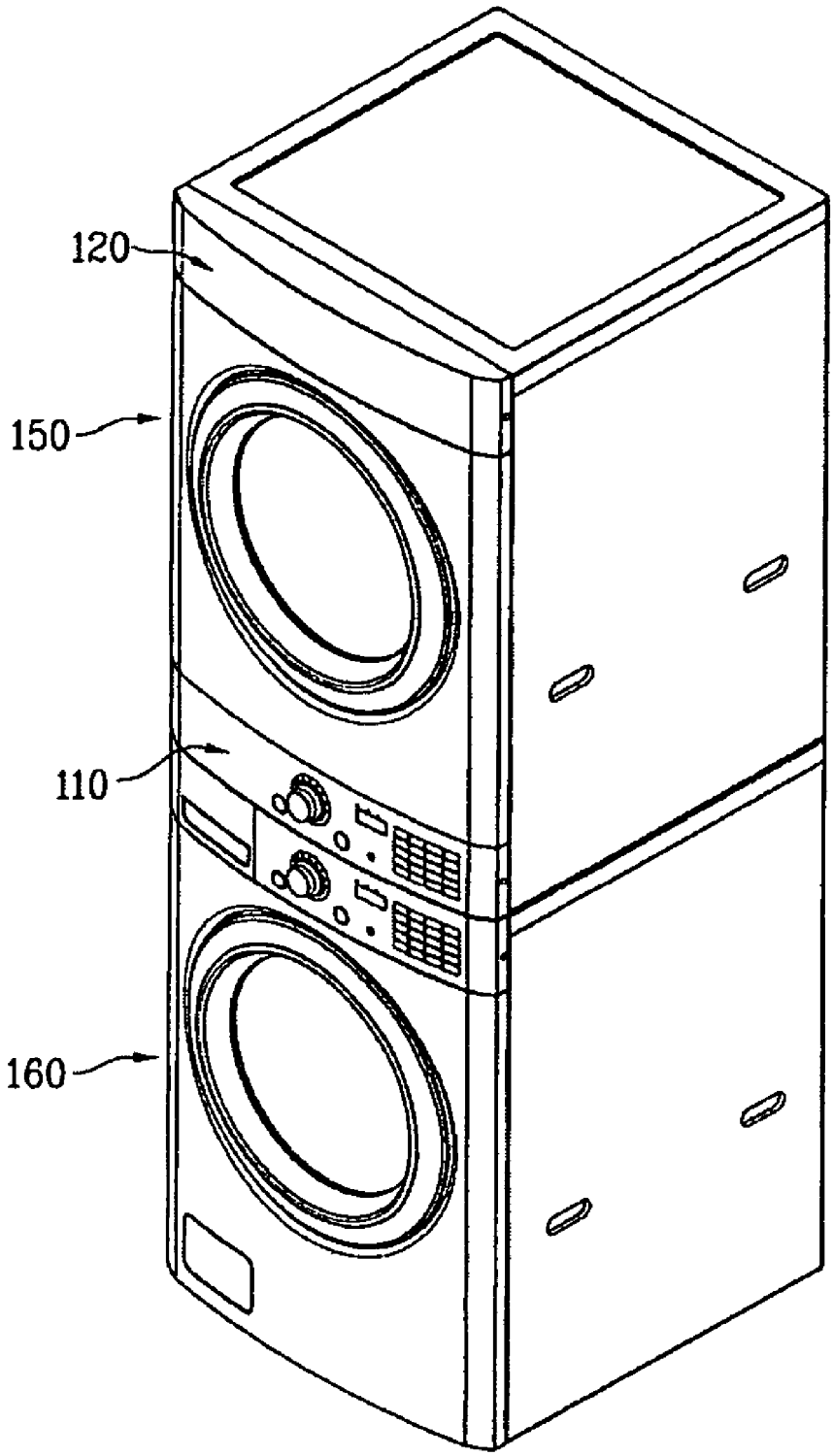
FIG. 8 is a perspective diagram of a dual laundry machine according to another embodiment of the present invention, which shows a dryer is installed on a washing machine.

A dual laundry machine according to the present invention is shown in FIG. 7 or FIG. 8.

FIG. 7 shows that a dryer 150 is provided next to a washing machine 160 in parallel. FIG. 8 shows that the dryer 150 shown in FIG. 2 is placed on the washing machine 160.

The dryer 150 shown in FIG. 7 or FIG. 8 corresponds to the former dryer shown in FIG. 2 and the washing machine corresponds to the related art washing machine. So, detailed explanations of the dryer 150 and the washing machine 160 are omitted in the following description.

Referring to FIG. 7, in case that the dryer 150 and the washing machine 160 are arranged parallel with each other, the user-interface unit 110 of the dryer 150 is assembled to the upper part of the body 100.

Referring to FIG. 8, if the dryer 150 is placed on the washing machine 160, the user-interface unit 110 is assembled to the lower part of the body 100.

Hence, a user is facilitated to perform a manipulation of the user-interface unit 100 if the dryer 150 is arranged next to the washing machine 160 in parallel or even if the dryer 150 is placed on the washing machine 160.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a body having a first position and a second position;

a main control unit controlling an operation of the laundry machine provided at a position spaced apart from the first position and the second position of the body;

a user-interface unit having at least one of an input unit and a display unit, the user-interface unit fixedly and operatively assembled at one of the first position and the second position of the body of the laundry machine to be configured to substantially form an appearance of a laundry machine, the user-interface unit wirelessly communicating data with the main control unit of the laundry machine; and a cover panel fixedly assembled at the other one of the first position and the second position of the body, wherein the user-interface unit being alternatively fixedly positioned at one of the first position and the second position of the body of the laundry machine.

2. The laundry machine of claim 1, wherein the wireless communication is infrared communication.

3. The laundry machine of claim 1, wherein the wireless communication is performed according to bluetooth.

4. The laundry machine of claim 1, wherein the user-interface unit includes both of the input unit and the display unit.

5. The laundry machine of claim 1, wherein the body includes a front surface, and the first position is an upper part of the front surface and the second position is a lower part of the front surface.

6. The laundry machine of claim 1, wherein the body includes a front surface, and the first position is a lower part of the front surface and the second position is an upper part of the front surface.

7. The laundry machine of claim 1, wherein the main control unit wirelessly communicates data to the display unit.

8. A laundry machine comprising:

a body that includes a first position and a second position;

a user-interface unit having an input unit or a display unit, the user-interface unit fixedly and operatively assembled at the first position or the second position of the body, and being configured to substantially form an appearance of a laundry machine;

a main control unit to control operation of the laundry machine, the main control unit provided at an area away from the first position and the second position of the body, wherein the user-interface unit wirelessly communicates data to the main control unit of the laundry machine; and a cover panel fixedly assembled at the first position or the second position of the body, wherein the user-interface unit being alternatively fixedly and operatively positioned at one of the first position and the second position of the body of the laundry machine.

9. The laundry machine of claim 8, wherein the user-interface unit wirelessly communicates to the main control unit using infrared communication.

10. The laundry machine of claim 8, wherein the user-interface unit wirelessly communicates to the main control unit using Bluetooth.

11. The laundry machine of claim 8, wherein the user-interface unit includes both the input unit and the display unit.

12. The laundry machine of claim 8, wherein the body includes a front surface, and the first position is an upper part of the front surface and the second position is a lower part of the front surface.

13. The laundry machine of claim 8, wherein the body includes a front surface, and the first position is a lower part of the front surface and the second position is an upper part of the front surface.

14. The laundry machine of claim 8, wherein the main control unit wirelessly communicates data to the display unit.

15. A laundry machine comprising:

a body that includes a front surface having a first position and a second position;

a user-interface unit having a display unit, the user-interface unit fixedly and operatively assembled at the first position or the second position of the body, and being configured to substantially form an appearance of a laundry machine;

a main control unit to control operation of the laundry machine, the main control unit provided within the body and away from the first position and the second position of the front surface, wherein the user-interface unit wirelessly communicates data to the main control unit of the laundry machine and the main control unit to wirelessly communicate data to the display unit of the laundry machine; and a cover panel fixedly assembled at the first position or the second position of the front surface, wherein the user-interface unit being alternatively fixedly and operatively positioned at one of the first position and the second position of the body of the laundry machine.

16. The laundry machine of claim 15, wherein the user-interface unit and the main control unit wirelessly communicate using infrared communication.

17. The laundry machine of claim 15, wherein the user-interface unit and the main control unit wirelessly communicate using bluetooth.

18. The laundry machine of claim 15, wherein the user-interface unit includes an input unit.

19. The laundry machine of claim 1, wherein the first position is an upper part of the front surface and the second position is a lower part of the front surface.

20. The laundry machine of claim 15, wherein the first position is a lower part of the front surface and the second position is an upper part of the front surface.

* * * * *